United States Patent [19]

Gross

[11] 3,972,610

[45] Aug. 3, 1976

[54] ELECTROPHOTOGRAPHIC APPARATUS FOR PRODUCTION OF PLURAL IMAGES ON A SHEET

[75] Inventor: Frank C. Gross, Wilbraham, Mass.

[73] Assignee: A. B. Dick/Scott, South Hadley, Mass.

[22] Filed: Apr. 9, 1973

[21] Appl. No.: 349,452

[52] U.S. Cl. ..... 355/7; 355/54; 355/64; 355/95

[51] Int. Cl.[2] ..... G03G 15/00

[58] Field of Search ..... 355/7, 10, 27, 53, 54, 355/64, 86, 95, 5

[56] References Cited

UNITED STATES PATENTS

| | | | |
|---|---|---|---|
| 3,390,989 | 7/1968 | Berman et al. | 355/27 X |
| 3,694,069 | 9/1972 | Yamaji et al. | 355/4 |
| 3,697,173 | 10/1972 | Sasaki et al. | 355/27 |
| 3,697,176 | 10/1972 | Kuehnle et al. | 355/27 X |
| 3,716,295 | 2/1973 | Nakajima et al. | 355/3 |
| 3,820,890 | 6/1974 | Kuehnle | 355/5 |

*Primary Examiner*—L. T. Hix
*Assistant Examiner*—James LaBarre
*Attorney, Agent, or Firm*—Norman H. Stepno; R. Duke Vickrey

[57] ABSTRACT

Apparatus for electrophotographically imaging a photosensitive film in which a fractional area of the film, selected by automatic or preprogrammed access, is electrostatically charged and thereafter exposed to a pattern of radiation, is moved along a path of travel to a second location at which the latent image is developed by the application of toning fluid, and is preferably returned along the path of travel to fix or fuse the developed image as a next adjacent area is indexed for exposure. Additional areas of the film may be sequentially imaged by repeating the above sequence or by reinserting the partially completed film at a later time and addressing any desired used or unused area.

26 Claims, 15 Drawing Figures

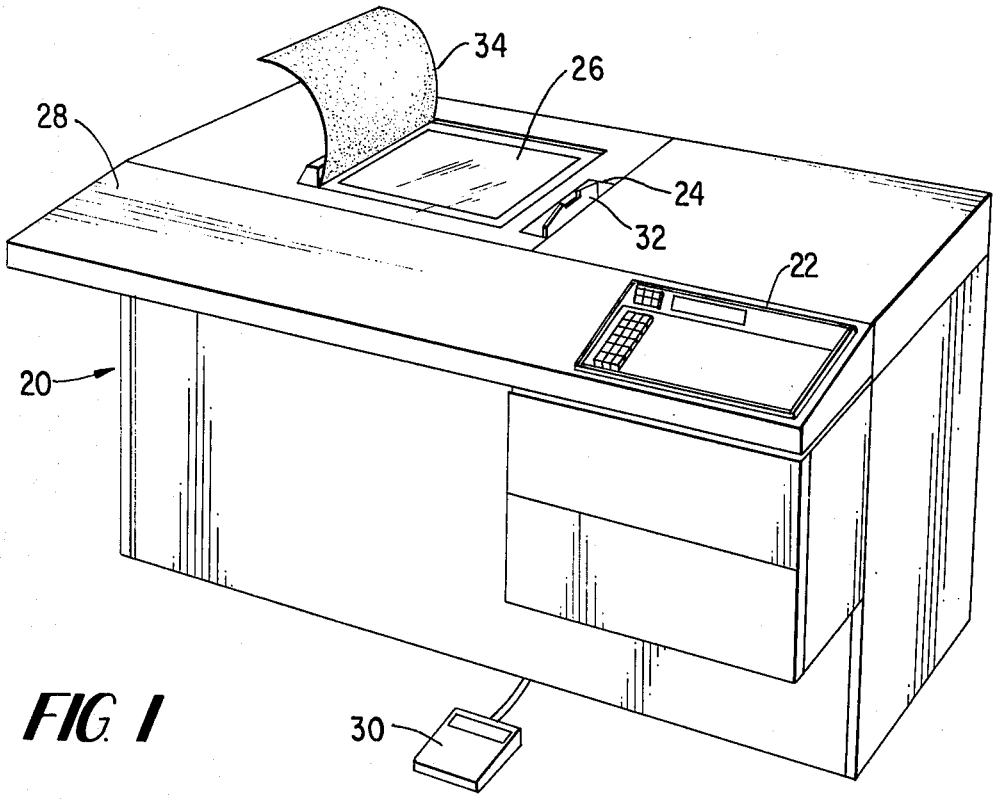
FIG. 1
FIG. 2
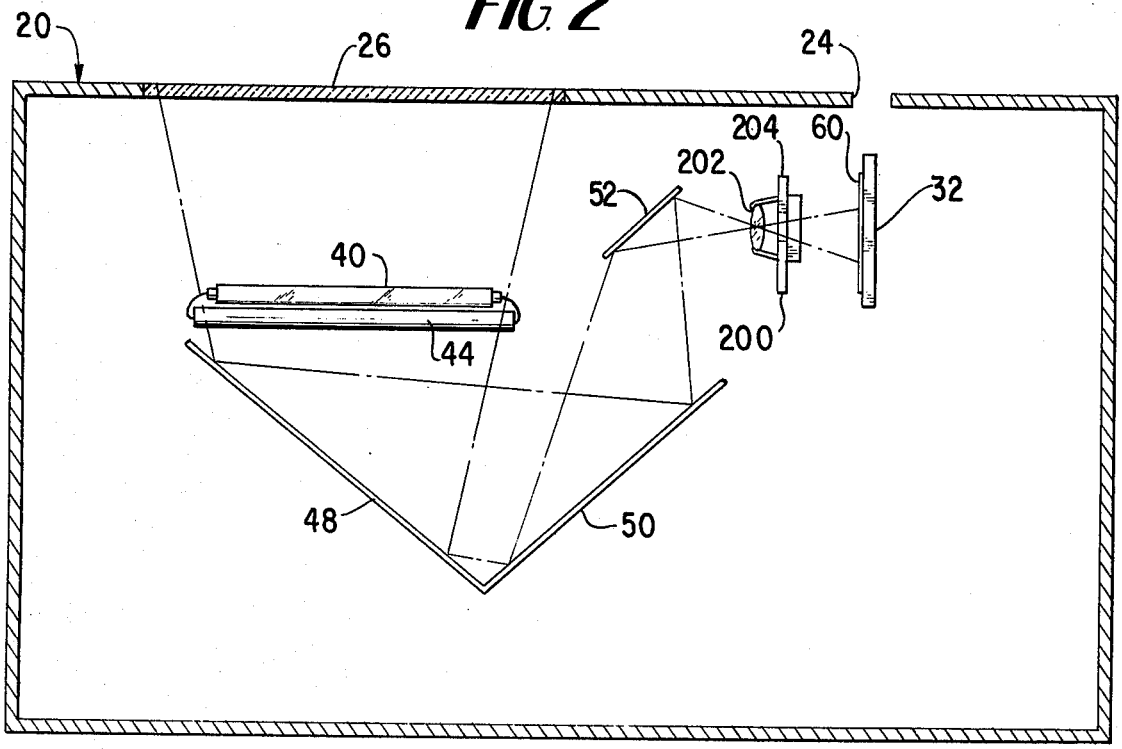

FIG. 3
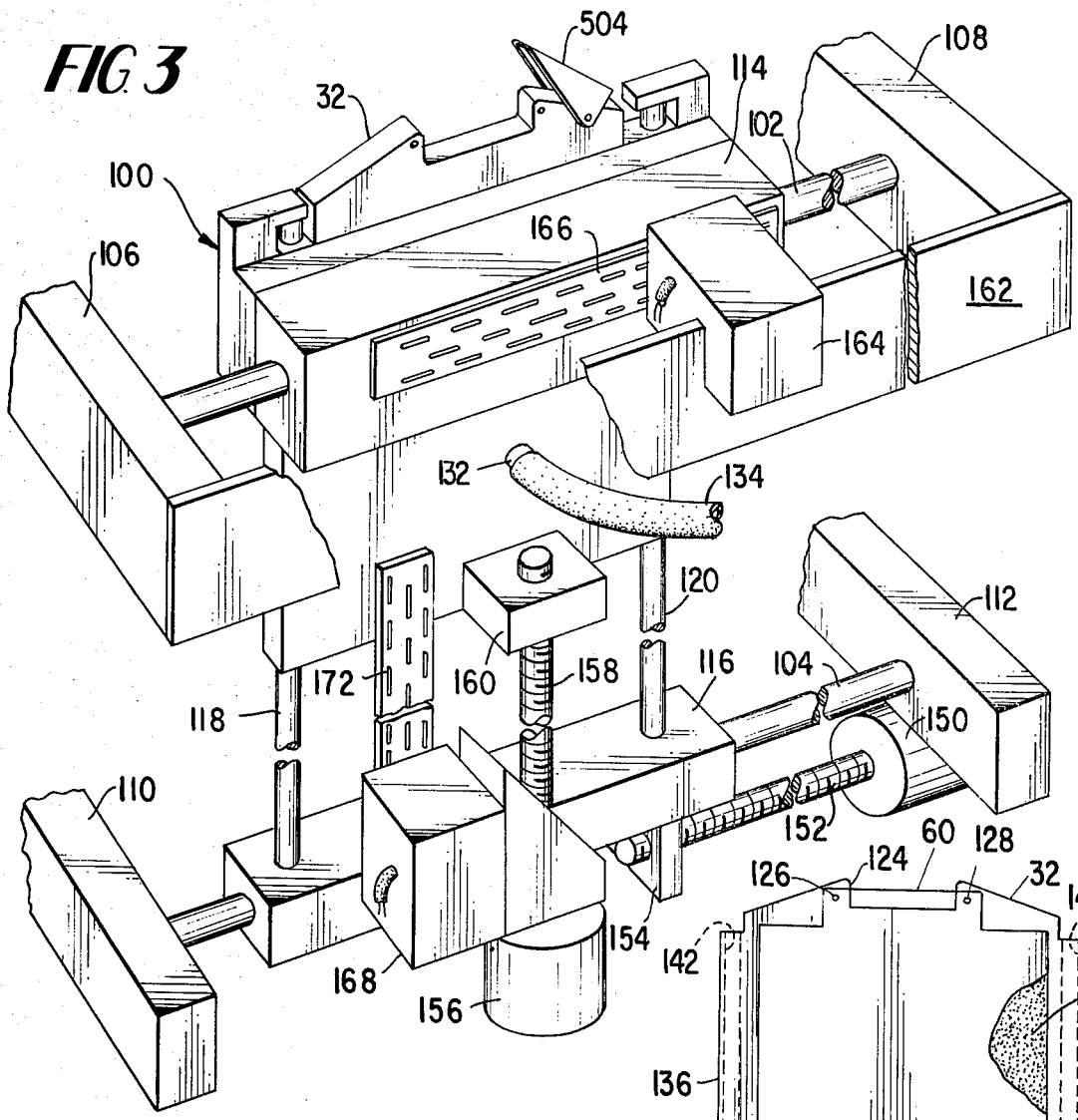
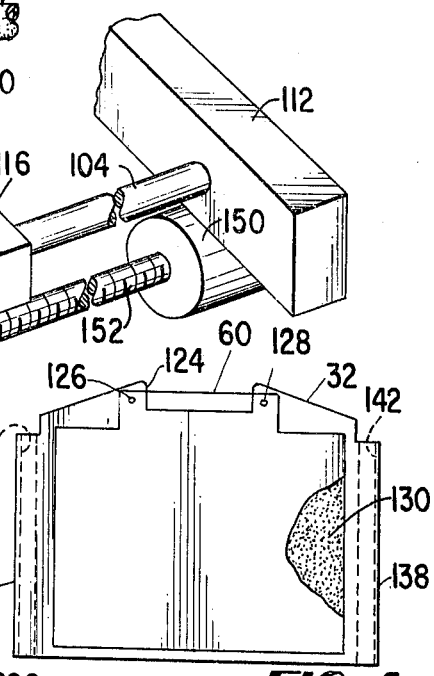
FIG. 4
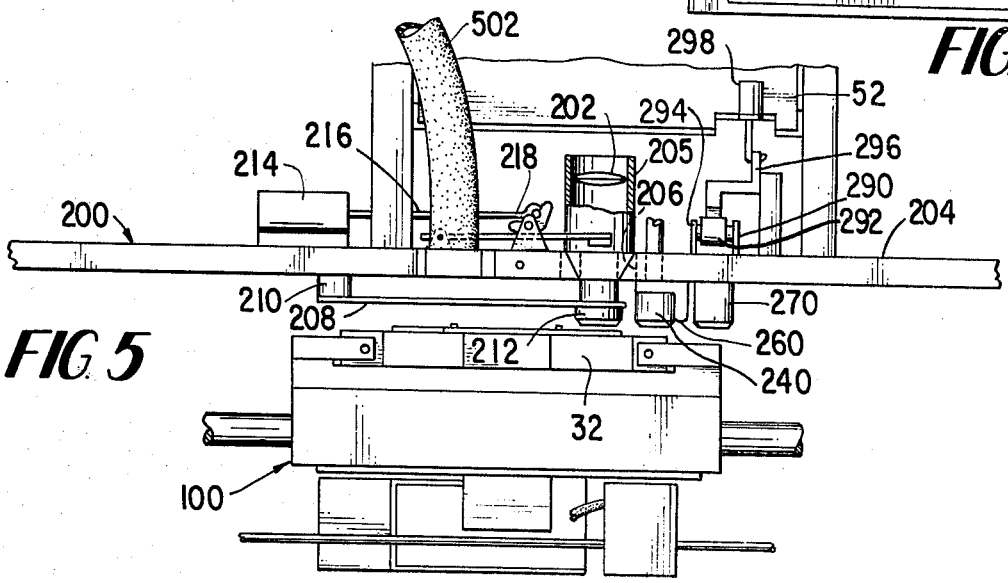
FIG. 5

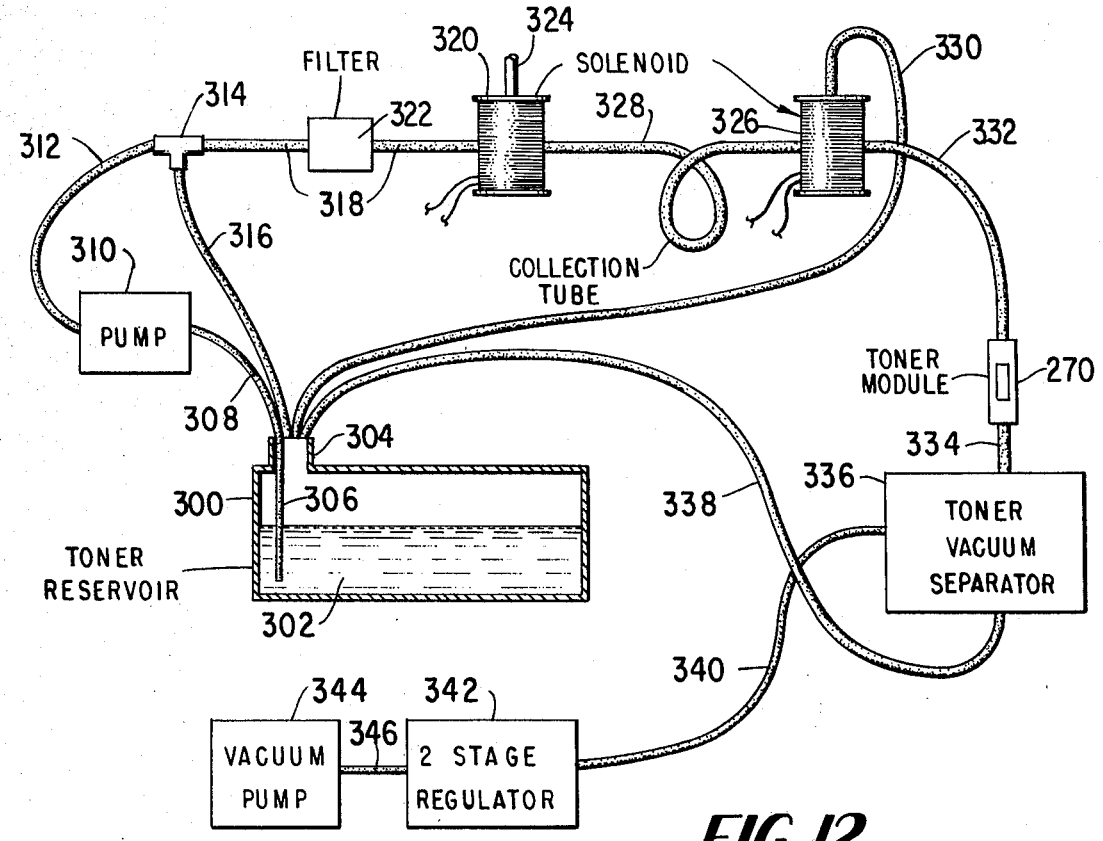
FIG. 12
FIG. 13
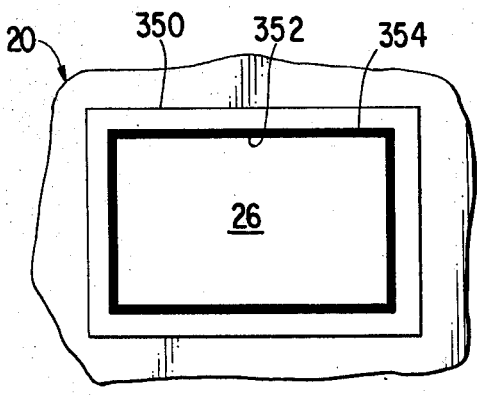
FIG. 14
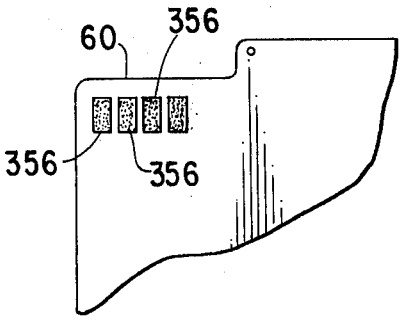

ELECTROPHOTOGRAPHIC APPARATUS FOR PRODUCTION OF PLURAL IMAGES ON A SHEET

BACKGROUND OF THE INVENTION

1. Field of the Invention

The present invention relates generally to systems for photographically storing data, and more particularly, to an electrophotographic method and apparatus for imaging selected fractional areas within a photosensitive film sheet.

2. Description of the Prior Art

Stimulated by the costs incurred in storing the ever-increasing volume of documentary material which is presently being generated, considerable effort has been expended in the past in the design and development of various electrophotographic and other data storage and retrieval systems. Particular emphasis has been placed on the design of microphotographic systems which may be used to decrease the physical bulk of such stored materials without sacrificing file retrieval and/or copy reproduction capabilities. Systems of this type are rapidly becoming as necessary as the conventional office copier because of the exorbitant storage costs and space requirements being encountered in both Government and private offices, schools, hospitals and in virtually every business, large and small.

A great number of microfilm systems, of both the photographic and microxerographic type, have been developed in the past and are generally satisfactory for their intended purpose. However, the above systems typically exhibit one or more disadvantageous characteristics which have proven to be serious drawbacks under normal conditions of operation. For example, conventional microfilm systems are often large and expensive, are inconvenient and/or complex to operate, do not provide full capabilities of selective imaging of individual microfiche frames either sequentially or by random access, do not readily enable the imaging of additional material onto partially filled film sheets, and incorporate either overly simplified or extremely complicated processing techniques requiring excessive processing time and/or resulting in images of poor quality.

SUMMARY OF THE INVENTION

Accordingly, it is an object of the present invention to accurately, efficiently and economically reproduce documentary material by photographic tecniques.

A further object of the present invention is to accurately, efficiently and economically reproduce documentary material by electrophotographic techniques.

Another object of this invention is accurately imaging full-scale source documents onto selected areas of a transparent electrophotographic microfilm sheet.

The present invention has a further object in the rapid sequential imaging of individual frames of a microfiche film sheet.

Another object of this invention is to image an electrophotographic film by exposing the same at a first position developing the exposed image at a second position, and fusing the developed image as the film is transported back toward the first position.

The present invention has another object in the imaging of certain unused areas of a previously, partially used photosensitive film sheet.

A further object of this invention is to precisely address one of a plurality of image areas in a microfiche sheet and thereafter image additional areas of the sheet in a preselected, sequential order.

The present invention may be summarized as an electrophotographic method and apparatus for imaging a photosensitive film characterized in the provision of an exposure assembly at a first position to electrostatically charge the film and thereafter expose a charged image area to a pattern of radiation, a developing assembly at a second position to develop the exposed image area, and a fixing assembly adjacent the first and second positions to fix or fuse the developed image.

This invention exhibits numerous advantageous features over the prior art in that it is compact, is capable of operating with minimal operator training and maintenance, provides accurate image reproduction with sequential or random access of individual image frames, and accomplishes rapid processing of each imaging sequence.

Other objects and advantages of the present invention will become apparent from the following description of a preferred embodiment when taken in conjunction with the accompanying drawings.

BREIF DESCRIPTION OF THE DRAWINGS

FIG. 1 is a perspective view of an electrophotographic apparatus in accordance with the present invention;

FIG. 2 is a diagrammatic sectional view showing the optical assembly of the apparatus of FIG. 1;

FIG. 3 is a perspective view of the carriage assembly of the apparatus of FIG. 1;

FIG. 4 is a front elevational view of the carrier plate of the carriage assembly of FIG. 3 showing a microfiche inserted thereon;

FIG. 5 is a top plan view of the carriage and processing assemblies of the apparatus of FIG. 1;

FIG. 12 is a diagrammatic view of the toner supply circuit of the processing assembly according to the present invention;

FIG. 13 is a plan view showing the underside of the copyboard of the apparatus of FIG. 1;

FIG. 14 is a partial plan view of a microfiche sheet containing certain images provided in accordance with the present invention.

DESCRIPTION OF THE PREFERRED EMBODIMENT

Figure 6:
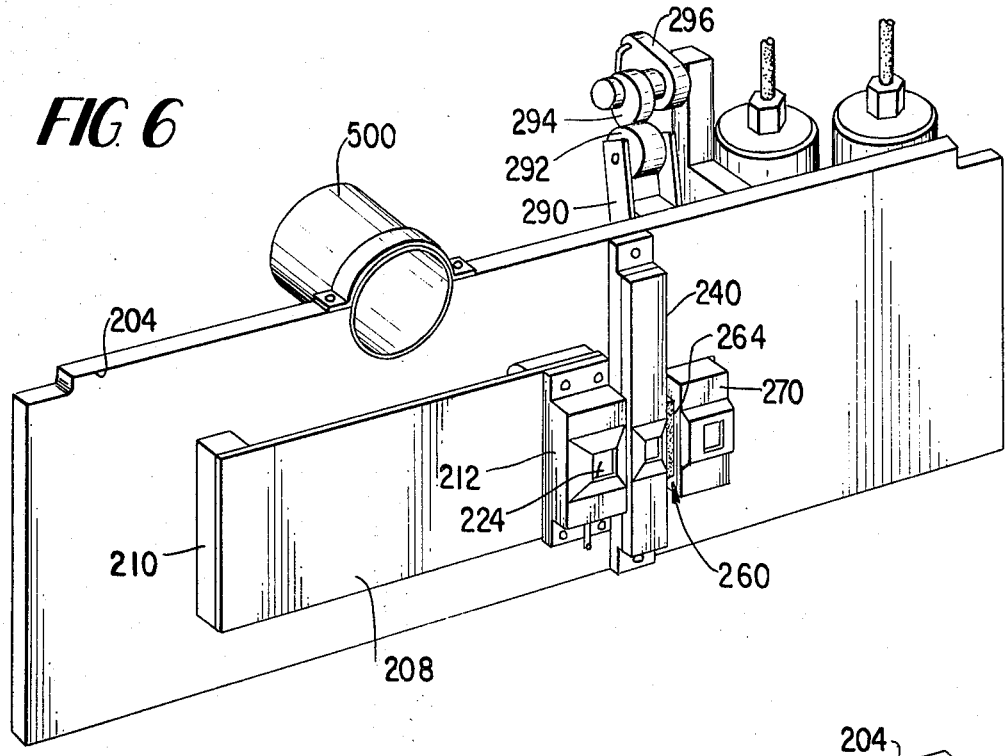
FIG. 6 is a front perspective view of the processing assembly of the apparatus of FIG. 1.

A preferred embodiment of the electrophotographic apparatus according to the present invention is illustrated in FIG. 1 and is self-contained within a housing of generally rectangular configuration, indicated generally at 20. The top of the housing 20 is generally flat in construction and is designed to incorporate an operator's console 22, a microfiche access slot 24, a copyboard assembly 26, and a desk portion 28 arranged generally as shown in FIG. 1. The operator console 22, as will be more fully described below, contains all necessary controls for operating the apparatus and cooperates with a foot switch 30 to enable the system operator to initiate a reproduction sequence by manual selection of the particular control on the console 22 or by depressing the foot switch 30.

A carriage assembly having a microfiche carrier plate 32 is disposed interiorly of the housing 20 such that the carrier plate 32 may be transported upwardly through slot 24 to a load position as illustrated in FIG. 1. In such position, a microfiche sheet may be easily inserted into the slot 24 and secured to the plate, as by a vacuum. The carriage assembly is adapted to accurately and rapidly transport the microfiche form its load position, internally of the housing for the accomplishment of a reproduction sequence. A set of manually operated selector switches on the console 22 enables the operator to precisely address a particular frame or image area of the microfiche for exposure, due to the interconnection of the console through appropriate logic networks to the carriage assembly drive mechanism, to be described below.

A suitable copyboard cover 34 which may be of any appropriate construction such as a flexible member of optically opaque material having a preferably white bottom surface is secured to the top of the housing 20 for selective opening and closing of the copyboard 26. While a manually operated cover flap 34 is illustrated for purposes of clarity, any suitable copyboard cover assembly may be incorporated with the present invention and, as such, may be automatically operated in conjunction with the sequence selector switches to eliminate the need for manually opening the copyboard is desired.

Before proceeding with a detailed description of the various systems and subsystems embodying the electrophotographic apparatus according to the present invention, a brief general description of the operation of the system will be presented for purposes of clarity.

The apparatus is turned on by pressing the appropriate switch on console 22 whereupon the system readily assumes a standby or ready mode for the initiation of a reproduction sequence. The ready state is indicated by the ignition of a suitable lamp on the control panel, and thereafter an operator may conveniently insert a microfiche sheet through slot 24 against the carriage plate 32. As noted briefly above, the microfiche sheet is drawn against the carrier plate 32 as by a vacuum, with appropriate locating pins on the carrier and guide holes in the fiche cooperating to assure accurate registration of the film sheet prior to the initiation of the reproduction sequence. Thereafter, the operator may position an original document face down atop the copyboard 26 with the copyboard cover 34 closed thereover.

If the inserted microfiche sheet has not been previously used, the operator need only actuate the appropriate position selector on the control console 22 whereupon the carriage assembly will rapidly and precisely transport the microfiche on carrier plate 32 into its home or addressed position for the exposure and imaging of the first frame or image area of the film sheet. The exposure sequence may then be initiated by depressing the exposure select button or the foot pedal 30.

If, on the other hand, the inserted microfiche sheet already contains certain imaged frames from a previous processing sequence, and it is desired to add additional documentary information, the carriage may be readily transported from its load position to the address of any unused frame such as the next frame in sequence. This is accomplished by programming the apparatus by means of a series of address selector switches each affixed with appropriate indicia representative of a particular column and row of the microfilm sheet. For example, if the last frame which has been used in the inserted microfiche is in the second or B row, third column, the operator need only depress the program selector switches corresponding to row B, column 4, and the position switch whereupon the carriage assembly will transport the microfiche to that precise position for imaging the B4 frame. When the addressing movement of the carriage has been completed, a suitable indicator lamp on the control console 22 will apprise the operator that the equipment is ready to begin a reproduction sequence. As before, the imaging process may thereafter be initiated by depression of the exposure control switch of console 22 or the foot switch 30.

The electrophotographic apparatus in accordance with the present invention is designed to accomplish the imaging of a particular frame or image area of a microfilm sheet within approximately 8 seconds, and automatically sequences or indexes the fiche to the next unused area of the row after reproduction such that additional frames may be rapidly imaged. Further, as the last frame in a particular row is completed, the carriage assembly will automatically transport the microfiche to the first frame in the next row such that the sequential completion of a full microfilm sheet may be accomplished automatically and within a minimum period of time.

Upon completion of a particular reproduction sequence, in which some or all of the image areas of the inserted microfilm sheet are imaged, the depression of the load selector switch on the control console 22 causes the carriage assembly to transport the carrier plate 32 back to its load position within slot 24 of the housing 20. The operator may thereafter readily remove the microfiche and file the same for future reference.

Referring to FIG. 2, the optical system for the electrophotographic apparatus of the present invention is shown diagrammatically and includes a pair of elongated cylindrical lamps 40 and 42 disposed in spaced relationship below the glass copyboard 26 along either side thereof above a respective one of a pair of generally U-shaped, elongated reflector member 44 and 46. Only one of the lamp and reflector combinations is illustrated in FIG. 2 for purposes of clarity. Both lamps are preferably xenon flash lamps of approximately 14 inches in arc length. A pair of mirrors 48 and 50 are disposed in a generally V-shaped arrangement, with mirror 48 approximately aligned under the copyboard 26 to reflect the image of the original document against mirror 50 from which it is reflected against a third mirror 52. Mirrors 48 and 50 are preferably affixed to the housing 20 while mirror 52 is carried by the processing assembly of the present invention, indicated generally at 200. The image from mirror 52 is directed through a lens element 202 carried by the frame 204 of assembly 200 to cause a substantially reduced image of the original document to be focused against a fractional area or image frame of a microfiche sheet 60. As noted above, the microfiche sheet is carried against the planar surface of carrier plate 32 of the carriage assembly, which is movable between its operative position within the housing 20 and a load position shown in FIG. 1 and in dashed lines in FIG. 2.

The carriage assembly, indicated generally at 100, is shown in detail in FIGS. 3 and 4. A pair of spaced, parallel support rods 102 and 104 are disposed horizontally within the housing 20 and are attached thereto by appropriate support brackets 106–108 and 110–112, respectively. Upper and lower guide blocks 114 and 116, of generally rectangular configuration, define a generally cylindrical bore adapted to cooperatively receive rods 102 and 104, respectively, for free translational movement along a generally horizontal path. Blocks 114 and 116 are connected together by a second pair of spaced parallel rods 118 and 120 disposed vertically between adjacent ends of the blocks 114 and 116, as illustrated. Guide blocks 114 and 116 together with rods 118 and 120 form a generally rectangular support frame subassembly which is integrally movable along rods 102 and 104 for horizontal translational movement of the carrier plate 32.

As best shown in FIG. 4, carrier plate 32 is of generally rectangular configuration having a generally peaked top surface defining a rectangular notch 124 to facilitate the insertion and removal of the microfiche sheet 60. A pair of pins 126 and 128 protrude from the front of plate 32 on either side of the recess 124 to provide positive registration of the microfiche sheet 60 by means of a pair of cooperative apertures defined therein in an upwardly protruding handling tab formed thereon. It is additionally noted that the apertures and pins of the microfiche sheet and carrier plate, respectively, may be asymmetrically positioned with respect to the plate to assure that the microfiche sheet will be positioned within the apparatus with the sensitive surface thereof oriented toward the processing assembly.

A central portion of the carrier plate 32 is provided with a sintered or porous insert 130 having its front surface contiguous with that of the plate 32. Insert 130 communicates through a connector 132 and a flexible tube 134 with a vacuum source (not shown), preferably disposed in a lower portion of the housing 20. In this manner, the negative pressure applied to the porous insert 130 causes the thin microfilm sheet 60 to readily adhere to the carrier plate 32 to assure the maintenance of proper registration of the film with the focal plane of the processing lens assembly.

A pair of elongated ears 136 and 138 are disposed along either side of the carrier plate 32 and define a pair of vertical bores 140 and 142, respectively, which are adapted to cooperatively accommodate rods 118 and 120 such that the carrier plate 32 may be freely moved in a vertical direction thereon.

A first precision stepping motor 150 is attached to the housing 20 with its axis parallel to rods 102 and 104 for driving a threaded shaft 152. Shaft 152 is received within the threaded aperture of a protruding tab 154 carried on block 116 as illustrated. Motor 150, shaft 152 and tab 154 coact to impart horizontal translational movement to the carriage assembly upon receipt of appropriate control signals from the system logic network as will be described below. While any suitable drive configuration may be utilized in accordance with the present invention, it is preferred that drive shaft 152 and the threaded aperture within tab 154 be cooperatively machined to advance the carriage assembly by one frame width upon a single complete rotation of the shaft of motor 150. In this manner, accurate indexing of the horizontal position of the carriage assembly may be readily and precisely accomplished by appropriate energization of motor 150.

Similarly, a second precision motor 156 is attached to block 116 with its axis disposed parallel to rods 118 and 120. Motor 156 drives a threaded shaft 158 which is adapted to be received within the threaded bore of a tab 160 protruding from the lower rear surface of carrier plate 132. Motor 156 thus imparts vertical translational movement to the carrier plate 32, with shaft 158 and the threaded bore of tab 160 preferably machined to advance the carriage assembly one-half frame height in the vertical direction upon one complete revolution of the shaft of motor 156. Thus, by the appropriate application of control signals to motors 150 and 156, the carrier plate 132 of carriage assembly 100 may be precisely and rapidly moved in both the $x$ (horizontal) and $y$ (vertical directions for imaging of the various selected frames of the microfiche sheet.

A generally flat plate 162 extends between member 106 and 108 to support a horizontal position detector assembly indicated generally at 164. A generally rectangular plate 166, suitably encoded with position or location information, is affixed transversely along element 114 adjacent the distal end of the detector assembly 164. Plate 66 cooperates with detector 164 to provide electrical signals to the system logic and control network indicative of the horizontal position of the carriage assembly during a reproduction sequence.

While any suitable position detection assembly may be incorporated with the carriage, it is preferred that the detector assembly be of the infrared type, with plate 166 defining a plurality of spaced reflective areas on a generally black background in a pattern designed to cause the detector 164 to generate logic controls signals representative of the horizontal position of the carriage assembly. A similar infrared position detector 168 is attached to the support bracket 170 for motor 156 and coacts with an encoded plate 172 attached to the carrier plate 32.

Thus, it can be appreciated that as the control signals applied to motor 150 cause the carriage assembly to be moved horizontally to a precise frame location, such movement will be sensed by the detector 164 for applying feedback information to the system logic. Likewise, vertical movement of the carrier plate 32 effected by the application of appropriate control signals to motor 156 will be sensed by detector 168 which translates the same into logic control signals.

Figure 7:
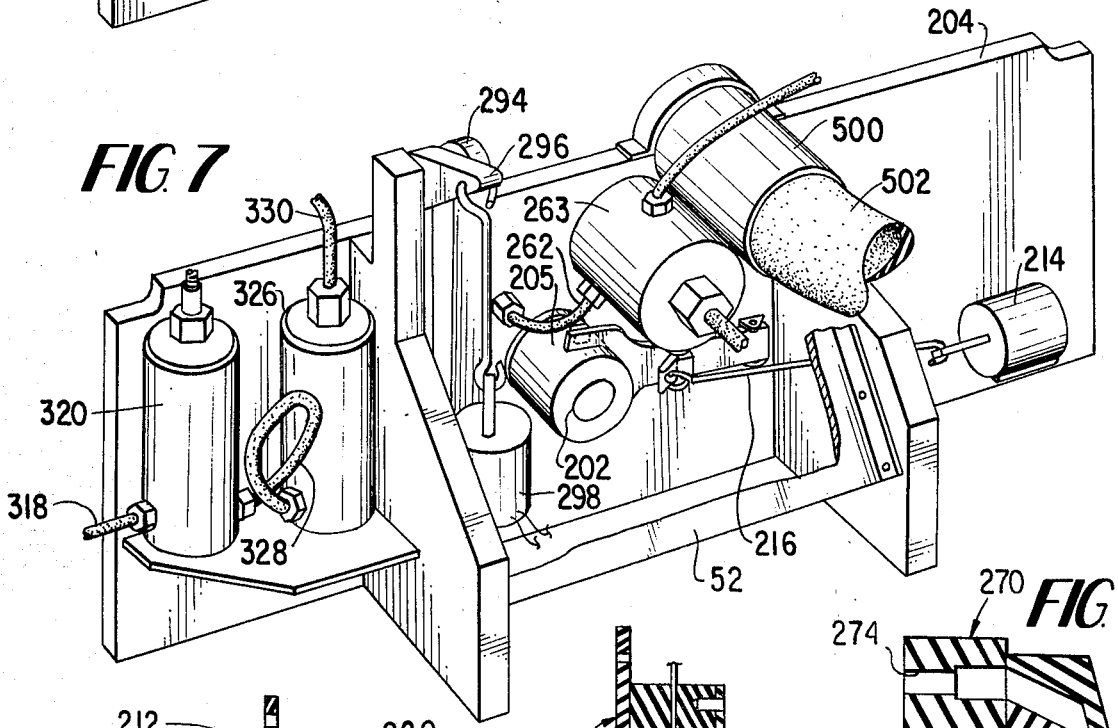
FIG. 7 is a rear perspective view of the processing assembly of FIG. 6 with parts broken away.

As shown in FIG. 5, the carriage assembly 100 is suitably mounted within the housing 20 adjacent the processing assembly 200. Referring to FIGS. 5, 6 and 7, the processing assembly 200 includes a main frame or mounting plate 204 upon which mirror 52 is supported in the proper attitude to reflect the source document image through lens 202. Lens 202 is mounted within a suitable support housing 205 disposed for free movement within an aperture 206 defined in the support plate 204. Housing 205 is affixed to the distal end of a generally rectangular, flat spring element 208 having its proximal end secured to plate 204 by an appropriate mounting block 210. Also secured to the distal end of spring plate 208 is a charge/expose module 212 of generally rectangular configuration open at both sides to allow the passage of the reduced source document image from lens 202 to the surface of a microfilm sheet.

Furthermore, it should be understood that an aperture is also formed in the distal end of spring element 208 between the lens housing 205 and the charge/expose module 212 such that the passage of light therethrough is unimpeded.

A solenoid 214 cooperates through a suitable linkage 216 and a cam mechanism, diagrammatically shown at 218, to effectuate a slight movement of the charge-expose module 212 from its normal or rest position as illustrated in FIG. 5 to an active position at which it contacts the surface of the microfiche sheet 60. It can be appreciated that in view of the fixed spacial relationship between the charge/expose module 212 and the lens 202, movement of the same upon leaf spring 208 preserves the focal integrity of the source document image which is to be impressed upon the microfiche sheet.

Figure 8:
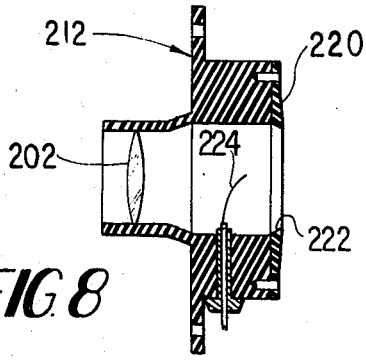
FIG. 8 is a cross-sectional view of the exposure module of the processing assembly of FIGS. 6 and 7.

Turning briefly to FIG. 8, there is illustrated a cross-sectional view of the charge/expose module 212. The charge/expose module is bounded by four walls made of a suitable electrically insulating material. Lens 202 is situated within housing 205 over one of the open sides of the rectangular housing, while a mask 220 covers the other open end of the housing to define an interior cavity. The mask 220 defines a generally rectangular opening 222 sized to approximately equal the desired image area or frame size to be applied to the microfiche sheet. The entire charge/expose module is constructed of a suitable electrically insulating material having sufficient structural rigidity to assure positive focal alignment of the lens 202 with the plane of the microfiche sheet.

A corona electrode 224 in the form of a thin wire is supported upon a suitable electrical terminal within the module housing such that the end of the corona electrode is disposed centrally of the mask opening spaced from the plane defined by the outer peripheral boundary thereof. The corona electrode is connected by lead 226 to a series network formed by an AC source 228 and a DC source 230.

Figure 9:
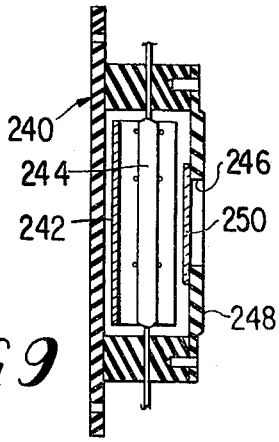
FIG. 9 is a cross-sectional view of the fixing module of the processing assembly of FIGS. 6 and 7.

Referring to FIGS. 5, 6 and 9, a fixing module 240 is rigidly secured to mounting plate 204 of the processing assembly 200 in horizontal alignment with the charge/expose module 212 approximately two frame-widths downstream thereof. The fixing module 240 is generally rectangular in configuration and defines a generally hollow rectangular cavity of substantially the same area as that of the charge/expose module. Supported against the rear wall of the fixing module is a reflective element 242 for directing electromagnetic radiation developed by a quartz encapsulated xenon flashtube 244 through a rectangular opening 246 approximately the same size as the microfilm frame to be imaged. Opening 246 is defined in a mask 248 which closes the fixing module 240 and thus precludes excessive glare and concomitant damage of adjacent frames. A colored optical filter 250 is mounted over the opening 246 to eliminate that part of the radiation emanating from the xenon flashtube to which the microfilm is sensitive. In this manner, radiation impinging upon adjacent frames as a result of the light flare from the mask opening is precluded from causing non-uniform excessive prexposure of areas on the microfiche to which imaging is not desired. The xenon flashtube 244 emits a high degree of electro magnetic radiation within an extremely short pulse time, i.e., in the millisecond range, to fix or fuse the toner particles applied to the imaged frame during the toning segment of the reproduction sequence.

As will be more fully described below, the fixing step is designed to occur as the carriage assembly is moving; however, because of the extremely short duration of the energy pulse from the fixing module, substantially the entire image area will be fused at a single instant of time. It is therefore necessary that the flashtube be energized with operating potential at the precise instant that the developed image is immediately adjacent the opening of the fixing module. This may be accomplished either by a suitable mechanical tripping linkage engaged by the carriage or appropriate electrical timing provided by the logic and control network of the apparatus directly to the electrical leads of the flashtube. Since any desired tripping and timing mechanism may be incorporated herewith, no attempt has been made to define the details of any particular assembly for the sake of brevity.

Figure 10:
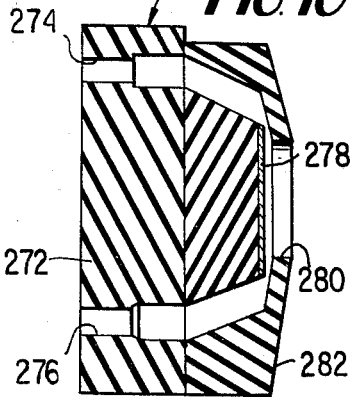
FIG. 10 is a cross-sectional view of the toner module of the processing asembly of FIGS. 6 and 7.

Preferably integrally constructed with the fixing module 240 is an air knife 260 designed to direct a stream of heated air from a suitable source 261 (FIG. 11) through a solenoid valve 263 and an air supply tube 262 to a narrow, slitlike nozzle 264 to assure complete drying of the developed latent image prior to the actuation and operation of the fixing module 240. While the air knife 260 may be constructed as a separate module, it is preferably integrally formed about the exterior of the fixing module 240 to conserve space. It is further noted, that the air knife assures complete drying of the liquid toner carrier prior to fixing, thereby avoiding undesirable destruction of the latent image caused by the boiling of residual carrier liquid during fixing. A toning module 270 is disposed adjacent fixing module 240 in horizontal alignment with both the fixing module and the charge/expose module 212. As shown in FIG. 10, the toning module 270 is constructed in generally rectangular form to define a cavity in which is mounted an electrically insulating insert 272 which cooperates with the interior side walls and the upper and lower walls of the toner housing to define a toner inlet port 274 and a toner outlet port 276. Inlet and outlet 274 and 276 communicate with each other interiorly of the toner module 270 in a generally rectangular passage bounded by an electrically conductive plate 278, the walls of the toner housing 270, and a generally rectangular opening 280 in the module mask 282. As will be described below, toner is drawn from a suitable supply reservoir through inlet port 274 and thence downwardly across the conductive plate 278 and the opening 280 into the outlet port 276. The same is preferably accomplished by vacuum to preclude leakage of toner fluid during and immediately following the reproduction sequence.

As in the case of the charge/expose module 212, the toner module 270 is constructed entirely of a suitable electrically insulating material, with the exception of the conductive plate 278 which is electrically floating. Electrode 278 is constructed of a thin sheet of conductive material substantially the same size as the charged area.

The present invention is adapted to provide both positive and negative images on the microfilm sheet. By reversing the DC polarity of the corona charge, and accordingly biasing the electrode 278 by suitable electrical connection, a positive source document may be recorded as a negative and vice versa.

Referring to FIGS. 5 and 7, the toner module 270 is movably mounted to plate 204 such that it may be shifted from its rest position, as shown in FIG. 5, to an operative position in sealed engagement with the surface of the microfilm sheet 60. A generally upright linkage member 290 is pivoted upon plate 204 at its lower end and supports module 270 at a point intermediate its length. The upper end of linkage member 290 is bifurcated to support a cam follower 292 adapted to ride upon a cam 294 pivotally mounted to the plate 204. Cam 294 is connected by an arm 296 to a solenoid 298 which, upon actuation, causes cam 294 to rotate and move the toner module 270 into engagement with the microfiche sheet.

Referring now to FIG. 12, the toner supply network in acccordance with the present invention is in the form of a closed system and includes a suitable toner reservoir 300 containing a supply of toner liquid 302. Liquid toner 302 may be of any suitable type well known in the art consisting of black colored electroscopic particles colloidally suspended in a liquid vehicle. A four-part connector block 304 communicates interiorly of the reservoir 300 and supports a toner pickup tube 306 which is connected to a supply conduit 308 feeding a toner pump 310.

Pump 310 supplies toner fluid via line 312 to a pressure relief or bypass valve 314 having first and second outlet ports communicating respectively with reservoir 300 via tube 316, and with the processing assembly via tube 318. Tube 318 feeds a first solenoid valve 320 through a suitable filter element 322. Solenoid valve 320 is vented to the atmosphere ar 324 and has its outlet port connected to the inlet of a second solenoid valve 326 by a short length of tube 328. Tube 328 has an internal volume corresponding to the amount of toner necessary to effectuate the development of a single image.

Solenoid valve 326 communicates with the fluid reservoir 300 by conduit 330 and has its outlet port coupled by a fluid line 332 to inlet port 274 of the toner module 270. Outlet port 276 of the toner module is returned via a conduit 334 to a toner vacuum separator 336 which separates unused toner and feeds the same tube 338 by gravity to the reservoir 300. A vacuum line 340 is also connected with the toner vacuum separator 336 and applies a negative pressure to the same through a two-stage regulator 342. Regulator 342 may be of any suitable construction known to those skilled in the art and is electrically controlled to provide both low and high vacuum levels to the vacuum separator 36. A vacuum pump 344 communicates with the two-stage regulator by line 346 to complete the system.

Turning now to FIGS. 13 and 14, a generally rectangular frame or mask 350 constructed of a suitable light colored material, such as while cardboard, is disposed atop the copyboard glass 26 and defines a rectangular opening 352 delineating the site area in which source documents may be placed for copying. Frame 350 has a dark, preferably black, inner peripheral border 354 which acts to provide a sharp black border about each image frame of the microfilm sheet. This is diagrammatically shown in FIG. 14 which depicts a partially filled electrophotographic microfiche 60 having four developed images, each confined within a sharp black rectangular border 356.

Figure 11:
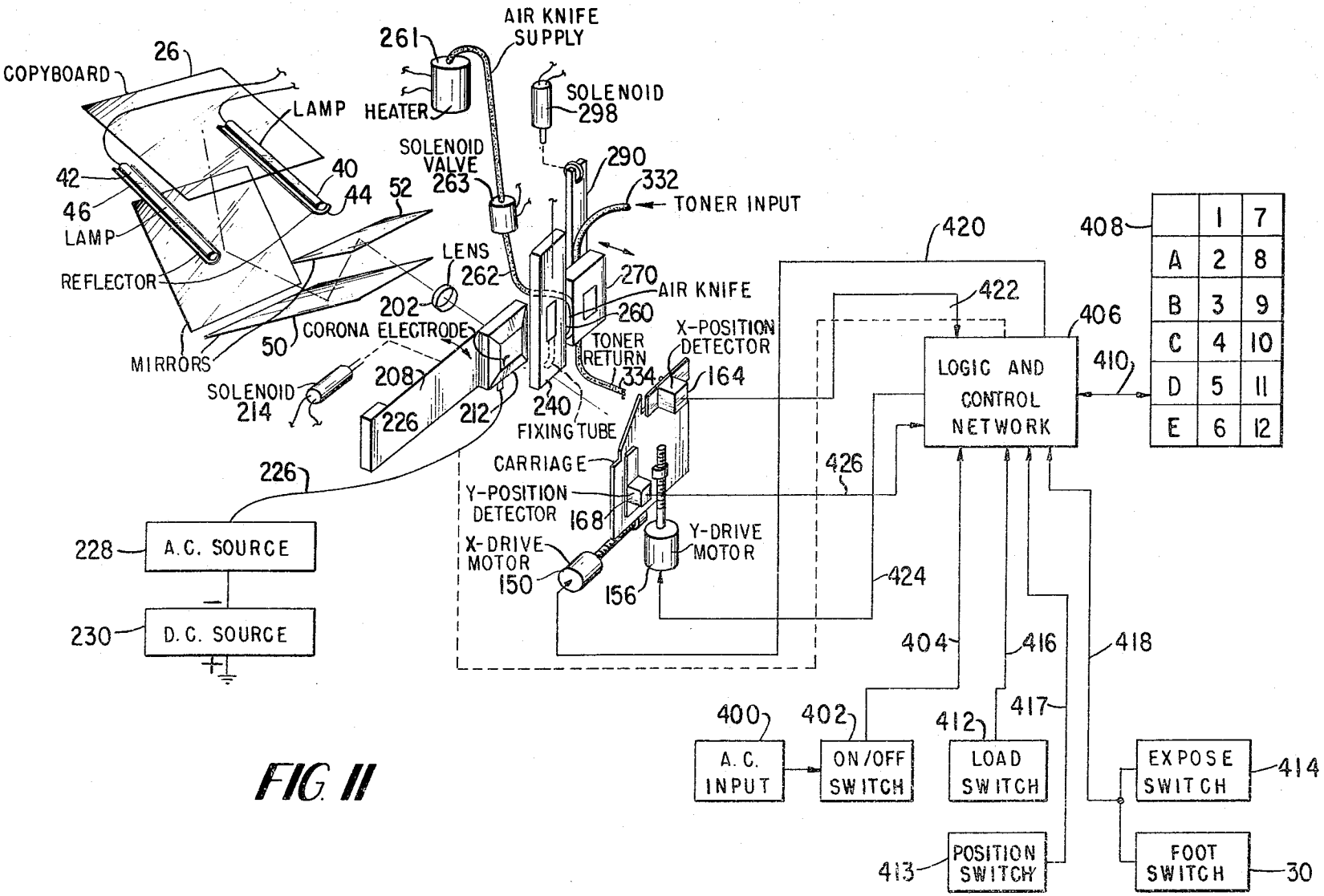
FIG. 11 is a diagrammatic perspective view of the electrophotographic assembly according to the present invention.

Referring now to FIG. 11, the electrophotographic apparatus according to the present invention receives alternating current from a suitable source of operating potential 400 which is applied through an on/off switch 402 via line 404 to the system logic and control network shown by block 406. The microfiche frame access keyboard 408, disposed in operator console 22, is likewise connected to the logic and control network 406 by a line 410. As illustrated, keyboard 408 contains a plurality of pushbutton selector switches each individually labeled with suitable indicia representative of a row, by letter, and a column, by number. In the illustrated example, the system is designed to microphotographically reproduce source document images on a microfiche having 60 frames arranged in five rows and twelve columns. Also connected to the logic and control network 406 are load and position selector switches 412 and 413, as well as an expose switch 414 and a parallel connected foot pedal 30. The load and position switches are tied to the logic network by lines 416 and 417, which switches 414 and 30 likewise connected to the logic network by line 418. The logic control network supplies operating control signals via line 420 for the horizontal drive motor, i.e., the *x* axis motor 150, and receives position indication signals from the *x* position detector 164 via line 422. Likewise, the logic and control network applies signal over line 424 to the *y* drive motor 156 and receives position indication signals from the vertical position detector 168 over line 426.

The logic and control network 406 may be constructed with conventional switching assemblies, of either solid state or relay type, to provide the desired control sequence for operating the system. The particular circuit details of the control system for the electrophotographic apparatus of the present invention may be of any suitable design accomplishing the sequence to be described below. In view of the great number of variations in the details of the control circuit network, which are well known to those of ordinary skill in the art, no attempt will be made herein to described any particular circuit in detail for the sake of brevity. However, the desired control sequence will be fully presented in accordance with the preferred mode of operation of the present invention as the description proceeds. It should also be understood that all of the various control solenoids, lamps, etc. are coupled with control network 406; however, the interconnecting wiring has not been illustrated for the sake of clarity.

In operation, the present apparatus and method is adapted to provide microimages of original or source documents upon a transparent electrophotographic film having a substrate of transparent material, such as a 5 mil polyester base, with a thin transparent conductive layer coated thereon as well as an additional outer layer of a suitable transparent photoconductive material. Any number of various films well known in the art may be utilized with equal efficacy in conjunction with the present invention as exemplified by those disclosed in U.S. Pat. Nos. 3,290,147, 3,314,788 and 3,615,404, which are by reference incorporated herein.

At the start of a reproduction sequence, a microfiche sheet 60 is inserted through slot 24 in the top of the housing 20, between the carriage plate 32 and the frame member 204 of the processing assembly 200 (see FIG. 5). As shown in FIG. 6, a generally cylindrical air nozzle 500 is disposed atop plate 204 immediately adjacent the front of the carrier plate 32 when the same is in its load position. A hose 502 cooperates with the nozzle 500 to supply the same with filtered air from a suitable blower (now shown) mounted within housing 20. In this manner, the air flow from nozzle 500 gently urges the microfiche 60 against the surface of carrier plate 32 and prevents the fiche from falling beyond the carrier plate.

The microfiche is thereafter properly aligned with pins 126 and 128 of plate 32 and is held in direct flat contact therewith by the vacuum applied through the porous block 130. In order to assure the establishment of ground or reference potential within the film sheet, suitable electrical connection is made between the conductive inner layer of the transparent electrophotographic sheet and the metallic carrier plate 32. This may be accomplished by any suitable means, such as a metallic shoe 504 pivotally affixed along the upper edge of plate 32 (see FIG. 3).

With the microfiche thus in position, the operator then places the source document face down atop the copyboard glass 26 within the site area defined by the border 350. The copyboard cover 34 is then closed over the glass plate 26 for the start of the reproduction sequence. Position switch 413 is thereafter actuated, whereupon the logic and control network 406 is signalled to advance the *x* and *y* stepping drive motors 150 and 156 to transport the microfiche 60 to its home position, with frame A1 in registration with the aperture 222 in the mask of the charge/expose module 212.

Figure 15:
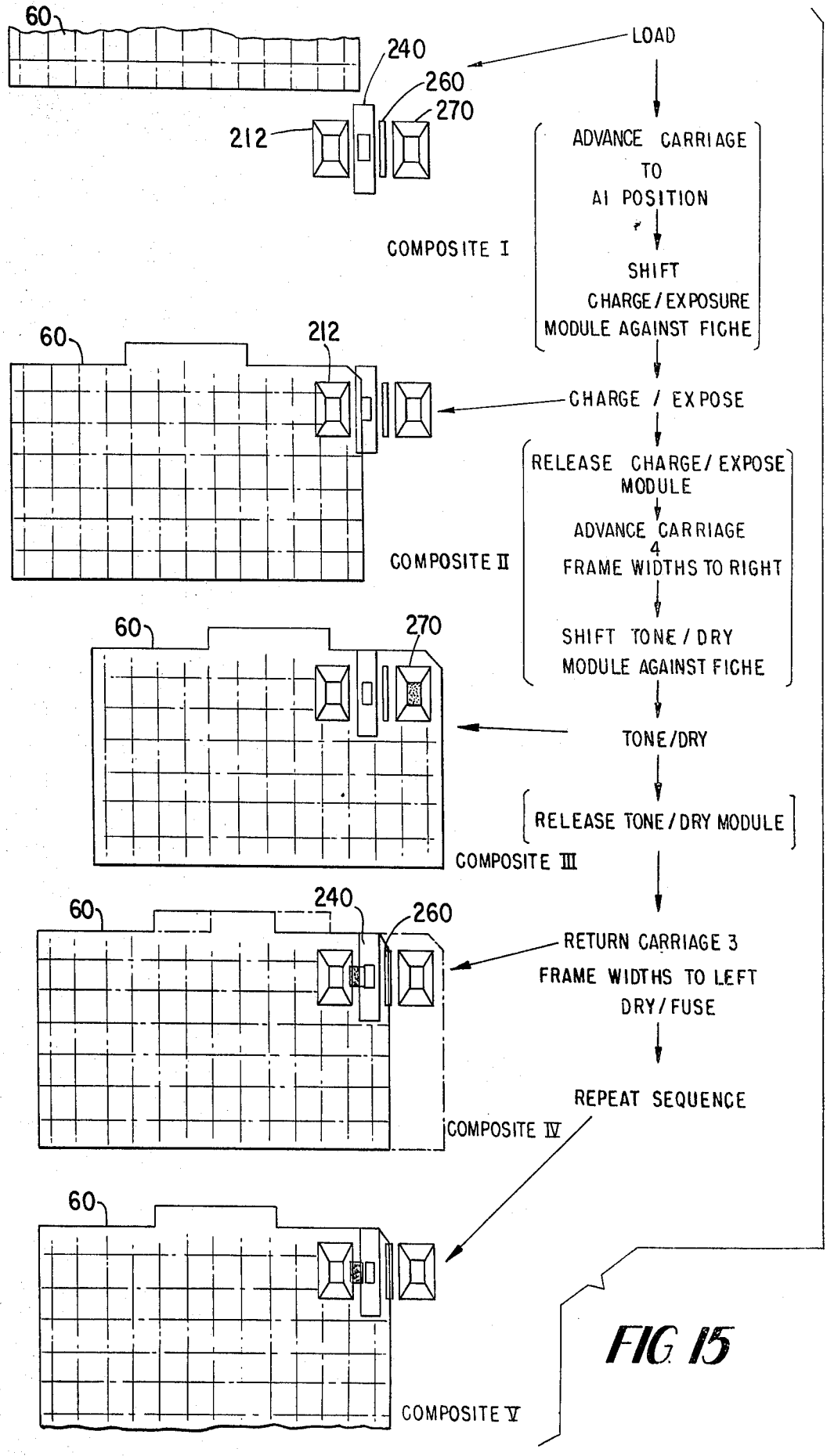
FIG. 15 is a diagrammatic flow chart illustrative of the electrophotographic method in accordance with the present invention.

Referring to FIG. 15, the microfiche is shown in composite I in its load position above the processing module, with the home position depicted in Composite II. As the carrier plate 32 reaches the home position, carriage location information sensed by detectors 164 and 168 is conveyed to the logic and control network which thereafter apprises the operator, as by energizing an appropriate indicator lamp on the console 22, that the reproduction sequence may be initiated. The operator may thereafter depress the expose switch 414 or the foot pedal 30 conditioning the logic and control network 406 to initiate the reproduction sequence. Initially, solenoid 214 will be actuated by the control network 406, causing the translational movement of the charge/expose module 212 toward the surface of the microfiche 60. With the charge/expose module 212 in its operative position in engagement with the surface of microfiche 60, the control network 406 causes the application of the DC biased AC corona potential via line 226 to the corona electrode 224. The particular fractional area defined by the A1 frame is thus uniformly charged within a relatively short period of time after which the corona potential is removed and lamps 40 and 42 are briefly ignited.

The light energy emanating from lamps 40 and 42 is reflected from the source document against mirrors 48, 50 and 52 which direct the same through lens 202. Lens 202 projects a substantially reduced image of the source document against the frame area of the electrosensitive microfiche 60 causing the development of an electrostatic latent image at frame A1. This is illustrated in composite II of FIG. 15, which depicts the activated state of module 212 and its functional relationship with the microfiche sheet 60.

After the latent electrostatic image has been impressed upon frame A1 of the microfiche sheet, the logic and control network 406 releases solenoid 214 to allow module 212 to return to its rest position (spaced from the surface of the film) under the biasing force of spring member 208. Logic network 406 thereafter applies a suitable control signal via line 420 to the horizontal drive motor 150 causing the advancement of carrier plate 32 a suitable number of frame widths, such as four, to the right as visualized in FIG. 3. After the carrier plate 32 has reached its shifted position, ad detected by position detector 164, the logic and control network 406 causes the actuation of solenoid 298 to shift the toner module 270 into sealed engagement against the surface of the microfiche sheet 60 at frame A1. The relative position of the various processing modules and the microfiche sheet 60 at this stage are depicted in composite III of FIG. 15.

With the toner module 27o in sealed engagement with the surface of the microfiche 60 (to preclude toner fluid leakage), solenoid valve 320 of the toner supply circuit is energized by the logic network 406 causing toner fluid to be pumped from reservoir 300 through solenoid valve 320 and tube 328 to the closed solenoid valve 326. Fluid thus circulates through tube 328 and solenoid 326 and is returned over line 330 to the reservoir 300. In this manner, tube 328 is filled with toner fluid in the precise amount necessary for effectuating the development of the previously applied latent image.

Solenoid valve 320 is thereafter closed, and solenoid 326 is simultaneously opened whereupon the metered amount of toner fluid contained within line 328 is applied over line 332 to the inlet port of toner module 270. Fluid is then drawn through the toner module under a low vacuum, at this point in the reproduction sequence, by the actuation of two-stage regulator 342 to its low rate setting. As a result, the precisely metered amount of toner fluid is drawn across opening 280 in mask 282 of the module 270 causing the development of the latent electrostatic image.

Solenoid valve 326 is then closed and solenoid 298 is de-energized allowing module 270 to be released to its rest position in spaced relationship with the surface of the microfiche sheet 60. At this time, the two-stage regulator 342 is advanced to its high vacuum mode thereby precluding the leakage of toner fluid exteriorly of the module 270 and effectuating a substantial drying of the developed microimage.

The logic and control network 406 thereafter applies an appropriate signal on line 420 causing the horizontal drive motor 150 to transport carrier plate 32 back to the left by a suitable number of frame widths, such as three, preferably one frame width less than the initial movement of the carriage as depicted in composite IV of FIG. 15. Prior to the start of the return movement, solenoid valve 263 is energized enabling the supply of heated air from source 261 to the hot air knife 260. Thus, as the developed image on frame A1 on the microfiche sheet 60 tranverses past the nozzle 264 of hot air knife 260, any residual fluid remaining from the toning and primary drying sequence is completely eliminated preparatory to the fixing or fusing step.

When the developed image on frame A1 is in registration with the fixing module 240, the flashtube 244 is energized causing a brief burst of electromagnetic radiation to be directed against the developed image. Consequently, the previously applied toner particles are fixed to the film surface thereby rendering the microimage permanent on the fiche 60. As noted above, it should be appreciated that the air knife drying and fusing sequences are accomplished as the carrier plate 32 is transporting the microfiche sheet 60 back toward its initial position, with the fixing operation occuring in a sufficiently short interval to fuse the entire image at virtually the same instant of time. When position detector 164 senses the return of carrier plate 32 three positions to the left, the horizontal drive motor 150 is de-energized causing the microfiche 60 to come to rest at a position where frame A2 is in registration with the charge/expose module 212. In this manner, the next image frame of the microfiche sheet 60 is automatically indexed in step-and-repeat fashion for the reproduction of a subsequent source document.

The above sequence may be repeated as desired until all of the source documents intended to be recorded on the microfiche sheet have been reproduced. Thereafter, the operator may energize or actuate load switch 412 causing the logic and control network 406 to advance drive motors 150 and 156 so as to transport the carriage up to its load position as shown in FIG. 1. The microfiche may be simply removed from the apparatus and can be thereafter stored for future reference. It is noted that the film may be conveniently handled in ambient light without image degradation and without sacrificing the ability of the film to accommodate additional information on unused frames or image areas as the need arises.

In the event that an operator desired to add additional documentary material to a previously, partially used or filled microfiche sheet 60, the above loading process is repeated with the appropriate switches of keyboard 408 actuated to advance the microfiche to the next or other unused area or frame on the film. As before, when the carrier plate 32 has been transported to the position at which the selected image frame is in registration with the charge/expose module 212, a suitable indicator will be energized on the console 22 apprising the operator that the exposure sequence may again be initiated.

From the foregoing, it will be apparent that the electrophotographic method and apparatus in accordance with the present invention rapidly and efficiently provides precise microimages of source documents with minimal processing time and effort. The present system, which can be operated by relatively unskilled personnel, thus facilitates the rapid and precise storage of information in microimage form, either on microfilm, mmicrofiche or microfiche cards, thereby greatly decreasing the volume of stored documents. Furthermore, by enabling automatic or random access of various image frames for reproduction, an operator is enablied to store related or additional items of information in any desired physical location on the film sheet.

Inasmuch as the present invention is subject to many variations, modifications and changes in detail, it is intended that all matter contained in the foregoing description or shown in the accompanied drawings shall be interpreted as illustrative and not in a limiting sense.

What is claimed is:

1. Photographic reproduction apparatus for imaging a photosensitive substrate which comprises:

i. discrete means for exposing a photosensitive substrate to a radiation pattern to form a latent photographic image;

ii. discrete means for developing said latent photographic image;

iii. discrete means for fixing said devloped image; and iv. means for transporting a photosensitive substrate through a predetermined path, said means (i), (ii) and (iii) being positioned along said path, and said means (iii) being positioned intermediate the means (i) and (ii).

2. Photographic reproduction apparatus as defined by claim 1, wherein the means (i) comprises a discrete charging/exposing station comprising means for impressing a substantially uniform electrostatic charge on only one of several predetermined fractional areas of the photosensitive substrate and means for exposing said charged fractional area to a radiation pattern to form a latent electrostatic image.

3. Electrophotographic apparatus for sequentially imaging successive frames of a multi-frame photosensitive substrate which comprises:

i. a discrete charging/exposing station positioned on a predetermined path and comprising means for impressing a substantially uniform electrostatic charge on one of said frames of said multi-frame photosensitive substrate and means for exposing said charged frame to a radiation pattern to form a latent electrostatic image;

ii. a discrete processing station positioned on said predetermined path and comprising means for developing said latent electrostatic image;

iii. a second discrete processing station positioned on said predetermined path and comprising means for fixing said developed image;

iv. indexing means for changing the relative position of said substrate to said stations (i), (ii), and (iii), said indexing means performing a single advancing step which changes the position of the first frame from station (i) to station (ii) and performing a single returning step which both changes the first frame from the position of station (ii) to station (iii) and positions a second frame at station (i), and v. said station (ii) is positioned in the advancing direction along said predetermined path from said station (i) and said station (iii) is positioned in the returning direction from said station (ii) along said predetermined path so that a single indexing step presents the developed first frame to the fixing station and the second frame to the charging/exposing station.

4. Electrophotographic apparatus as defined by claim 3, wherein the means (iv) comprises step and repeat indexing means adapted to produce plural rows and columns of images on the photosensitive substrate.

5. Electrophotographic apparatus as defined by claim 3, wherein the said indexing means (iv) are adapted to present any selected one of the frames of a multi-frame photosensitive substrate to said station (i).

6. Electrophotographic apparatus as defined by claim 4, wherein the plural rows and columns of images are defined along the $x$ and $y$ axes thereof.

7. Electrophotographic apparatus, as defined by claim 3 further comprising means for drying the developed image.

8. Electrophotographic apparatus as defined by claim 7, wherein the drying means comprises a hot air knife positioned intermediate said stations (ii) and (iii) along the said predetermined path.

9. Electrophotographic apparatus as defined by claim 7, wherein said station (ii) is provided by a processing module which includes means for drying the developed image.

10. Electrophotographic apparatus as defined by claim 3, wherein stations (i) and (ii) are provided by discrete modules which are adapted to both engage and disengage the sensitive side of the photosensitive substrate when a frame is positioned at station (i) or (ii), respectively, for processing by that station.

11. Electrophotographic apparatus as defined by claim 10, wherein the photosensitive substrate is a transparent electrophotographic film, said transparent electrophotographic film being a microfiche card.

12. Electrophotographic apparatus as defined by claim 10, wherein said station (iii) is fixedly spaced from the sensitive side of the photosensitive substrate when indexed through said predetermined path.

13. Electrophotographic apparatus as defined by claim 12, wherein said station (i) comprises a charging-/exposing chamber having an aperture in the chamber wall and being adapted to engage the sensitive side of the photosensitive substrate at said aperture, and wherein said station (ii) comprises a developing chamber having an aperture in the chamber wall and being adapted to engage the sensitive side of the photosensitive substrate at said aperture.

14. Electrophotographic apparatus as defined by claim 13, further comprising means to bias said staion (i) against the senstive side of the photosensitive substrate, and means to bias said station (ii) against the sensitive side of the photosensitive substrate to seal the chamber aperture thereof with the said sensitive side of the said photosensitive substrate.

15. Electrophotographic apparatus as defined by claim 3, wherein said stations (i), (ii), and (iii) have fixed positions on said predetermined path and said indexing means transports said photosensitive substrate along said predetermined path.

16. Electrophotographic apparatus as defined by claim 15, including support means for supporting said photosensitive substrate, said support means being transported by said indexing means.

17. Electrophotographic apparatus as defined by claim 3, wherein said station (iii) is positioned on said predetermined path between said station (i) and said station (ii).

18. Electrophotographic apparatus as defined by claim 3, wherein said station (i) is provided by a discrete charging/exposing module which includes an optical lens system having a lens axis and means fixed along the optical path of said lens system for impressing a substantially uniform electrostatic charge on the photosensitive substrate.

19. Photographic reproduction apparatus for imaging a photosensitive substrate which comprises:

i. indexing means for advancing a photosensitive substrate through a predetermined path;

ii. discrete means positioned along said path comprising means for exposing only a selected one of several predetermined fractional areas of the photosensitive substrate to a radiation pattern to form a latent photographic image;

iii. discrete means for developing said latent photographic image positioned along said path at a distance of $x$ predetermined fractional areas downstream of the said exposure means (ii);

iv. discrete means for fixing said developed image positioned along said path intermediate the means (ii) and (iii) and at a distance of less than $x$ predetermined fractional areas downstream of the said exposure means (ii).

20. Photographic reproduction apparatus as defined by claim 19, wherein the means (ii) comprises a discrete sensitizing/exposing station for impressing a substantially uniform electrostatic charge on the said selected one of the several predetermined fractional areas of the said photosensitive substrate and for exposing the charged fractional area to a radiation pattern to form a latent electrostatic image.

21. Photographic reproduction apparatus as defined by claim 19, wherein the means (ii) comprises an optical lens system and a discrete charging/exposing station for impressing a substantially uniform electrostatic charge on the said selected one of the several predetermined fractional areas of the said photosensitive substrate and for exposing the charged fractional area to a radiation microimage pattern through said lens system to form a latent electrostatic microimage.

22. Photographic reproduction apparatus as defined by claim 21, wherein the indexing means (i) are designed to advance the photosensitive substrate through a predetermined straight path.

23. Photographic reproduction apparatus as defined by claim 22, wherein the indexing means (i) are designed to advance the photosensitive substrate through a predetermined, folded straight path.

24. Photographic reproduction apparatus as defined by claim 23, wherein the developing means (iii) are at a distance of 4 or 5 predetermined fractional aras downstream of the means (ii).

25. A microelectrophotographic recording organization which comprises:

i. a surface for supporting intelligence to be microreproduced;

ii. means for supporting a transparent electrophotographic microfiche card;

iii. means for illuminating the surface and reflecting an image of the intelligence therefrom;

iv. means for directing the reflected image through a lens system having a lens axis, said lens system comprising v. a discrete charging/exposing module, said module also comprising means for impressing a substantially uniform electrostatic charge on only a selected one of several predetermined fractional areas of the microfiche card and means whereby a microimage is projected and exposed onto the charged fractional area of the said microfiche card to form a latent electrostatic microimage;

vi. a discrete processing module comprising means for developing said latent electrostatic microimage;

vii. a second discrete processing module comprising means for fixing said developed microimage;

viii. indexing means for moving said selected one of said several fractional areas through a predetermined path past said modules (v), (vi) and (vii) and along which predetermined path and parallel thereto are positioned the said modules (v), (vi) and (vii), said indexing means presenting a selected second of said several predetermined fractional areas of said microfiche card to said module (v) as the said selected one of said several fractional areas has advanced at least to a point of registration with said fixing module (vii), said predetermined path including an advance/return segment;

ix. means for actuating said discrete processing modules (v), (vi) and (vii) to successively perform their respective functions of charge/expose, develope and fix according to pre-programmed sequential access, said pre-programmed sequential access being functionally coordinated with said indexing means (viii); and x. logic network and control means for automatically activating and functionally coordinating said indexing means (viii) and said actuating means (ix).

26. Microelectrophotographic recording organization as defined by claim 25, wherein the surface (i) comprises a mask for the intelligence to be microreproduced and adapted to provide a distinct border surrounding the microimage recorded on the microfiche card.

* * * * *